United States Patent [19]

Dibrell et al.

[11] Patent Number: 4,513,576

[45] Date of Patent: Apr. 30, 1985

[54] GAS PRESSURE OPERATED POWER SOURCE

[75] Inventors: Edwin W. Dibrell; Charles D. Wood, both of San Antonio, Tex.

[73] Assignee: Centrifugal Piston Expander, Inc., San Antonio, Tex.

[21] Appl. No.: 560,305

[22] Filed: Dec. 12, 1983

[51] Int. Cl.[3] ..... F25D 9/00

[52] U.S. Cl. ..... 62/87; 62/403; 62/467; 62/499; 165/86

[58] Field of Search ..... 62/499, 401, 403, 467, 62/87; 165/86

[56] References Cited

U.S. PATENT DOCUMENTS

| | | | |
|---|---|---|---|
| 1,323,785 | 12/1919 | Nichol | 62/403 |
| 1,511,985 | 10/1924 | Spencer | 62/403 |
| 2,174,584 | 10/1939 | Imus | 62/136 |
| 2,175,162 | 10/1939 | Waterfill | 62/136 |
| 2,716,971 | 9/1955 | Sykes | 123/46 |
| 2,730,874 | 1/1956 | Schelp | 62/402 |
| 3,052,106 | 9/1962 | Sanpietro et al. | 62/402 |
| 3,648,670 | 3/1972 | Siddons | 123/42 R |
| 3,896,632 | 7/1975 | Huntley | 62/88 |
| 4,022,032 | 5/1977 | Nott | 62/499 |
| 4,197,715 | 4/1980 | Fawcett et al. | 62/467 |

*Primary Examiner*—Ronald C. Capossela

*Attorney, Agent, or Firm*—Norvell & Associates

[57] ABSTRACT

The disclosure provides an oscillatable body mounting a cylinder defining an elongated fluid pressure chamber having at least one end thereof remotely located with respect to the axis of oscillation. The elongated fluid pressure chamber accommodates a free piston which reciprocates along the length of the chamber according to fluid pressure applied thereto. Solenoid operated inlet and exhaust valves are provided at each end of the elongated fluid pressure chamber, and sensing devices, responsive to the passage of the free piston therethrough are disposed on opposite ends of the elongated fluid pressure chamber and adjacent the medial portions thereof to control the operation of the inlet and exhaust valves in accordance with the desired objective to either maximize the extraction of mechanical energy from a pressured gas in the form of oscillating movements of the body, or maximize the expansion of the pressured gas to derive the greatest possible cooling effect therefrom.

21 Claims, 11 Drawing Figures

GAS PRESSURE OPERATED POWER SOURCE

BACKGROUND OF THE INVENTION

1. Field of the Invention

The invention relates to a method and apparatus for efficiently extracting heat and mechanical energy from a pressured gas by expanding same in an oscillatable fluid pressure chamber containing a free piston.

2. Description of the Prior Art

In the co-pending application of EDWIN WALTER DIBRELL, Ser. No. 436,852, filed Oct. 25, 1982 now abandoned, and assigned to the Assignee of this application, there is disclosed a form of centrifugal piston expander. Such expander comprises a rotating body upon which an S-shaped cylinder is mounted for co-rotation. A motor initiates such rotation. The S-shaped cylinder defines an S-shaped fluid pressure chamber, extending in a curve from one periphery of the rotating body inwardly through or proximate to the axis of rotation, and then extending outwardly by a reverse curve to a diametrically opposed outer portion of the rotating body. A free piston, having either a ball or oval shaped configuration is slidably and sealably mounted within the S-shaped fluid pressure chamber. Inlet and exhaust valves are provided on each of the two ends of the S-shaped cylinder. Centrifugal force will position the free piston in one of the outer ends of the S-shaped fluid pressure chamber.

The application of a charge of pressured gas through the inlet valve closest to the free piston will cause the piston to move inwardly along the S-shaped fluid pressure chamber and effect the exhaust of any gas remaining in the chamber on the forward side of the piston through the opened exhaust valve at the opposite end of the S-shaped fluid pressure chamber. The inlet valve is closed after the desired charge of pressured gas is introduced into the S-shaped fluid pressure chamber, and the piston continues its travel toward the end of the diametrically opposite end of such chamber, aided by centrifugal force after it passes the axis of rotation. As it approaches such opposite end, the exhaust valve is closed, and a cushion of gas is thus provided to arrest the movement of the piston adjacent the opposite extreme end of the S-shaped fluid pressure chamber. The pressure created in the remaining gas initiates the return movement of the piston and, concurrently or subsequently, the inlet valve adjacent to the piston can be opened to add a charge of gas to the fluid pressure chamber to move the piston along its return path to repeat the cycle.

It was anticipated that the reaction forces on the end walls of the S-shaped fluid pressure chamber produced both by the initial charge of gas and also by the pressure build-up of the trapped pocket of gas used to arrest the movement of the piston would produce a very significant torque aiding in the rotation of the rotatable body and thus permit the device to function as a source of rotating power.

There are, however, a myriad of variables to be considered. The overall diameter of the S-shaped fluid chamber, the internal diameter of the S-shaped fluid chamber, the internal diameter of the S-shaped fluid chamber, the length of the path of the piston, the curvature of the piston path, the pressure of the gas supplied to the device, the rotational velocity, the length of time that the pressured gas is supplied and, most importantly, the mass of the free piston, all are significant factors affecting the performance of the apparatus. A computer simulation of the aforedescribed device revealed that for a number of selected dimensions, pressures and weights, while high torque was produced during a period of the operating cycle no significant net torque was produced by the aforedescribed device whenever it was assumed that the apparatus was continuously rotating. These results would obviously seriously limit the utility of the aforedescribed apparatus.

The same type of computer simulation was also performed for a variety of other centrifugal piston expander configurations, such as those disclosed in the co-pending application of EDWIN WALTER DIBRELL, Ser. No. 436,412, filed Oct. 25, 1982 now U.S. Pat. No. 4,449,379 and assigned to the Assignee of the instant application. Thus, the cylinder configuration can range from a straight line or linear path of movement for the free piston to a curved path of movement terminating proximate to the axis of rotation, a spiral path, or even a helical-spiral path, all as disclosed in said co-pending application. The computer simulation of other types of configurations also indicated that for certain combinations of the aforementioned variables involved in the design of a particular expander, the resultant torque output could be best described as an oscillating torque operating on the rotating body mounting the centrifugal piston expander and, in some instances, being superimposed on a positive torque operating in a constant direction.

SUMMARY OF THE INVENTION

This invention contemplates utilizing a centrifugal expander device of the type disclosed in the aforementioned pending applications as a source of reciprocating power. It was discovered through computer simulation, that the apparatus defined in the aforementioned pending application would, if allowed to start from an at rest position, function to efficiently produce successive pulses of torque exemplified by oscillating movements of the rotationally mounted body carrying the cylinder or cylinders. Moreover, surprising large magnitudes of torque are produced by the device despite the fact that it initiates operation from an at rest position. In fact, the larger the load torque, the greater is the output torque developed by the expander. This characteristic makes the expander device very desirable as a driving mechanism for relatively massive devices requiring reciprocating movements. For example, the device can be utilized to drive the oscillating pumping beam of a subterranean well pump. Alternatively, the device could be employed to drive a reciprocating generator, or a reciprocating pump for transferring large volumes of water for irrigation purposes at relatively low pressure. Of course, a crank linkage can be employed to drive a rotational load, such as a conventional generator.

Further advantages of the invention will be readily apparent to those skilled in the art from the following detailed description, taken in conjunction with the annexed sheets of drawings on which are shown several embodiments of the invention.

BRIEF DESCRIPTION OF THE DRAWINGS

Referring to FIG. 1, an oscillating power output engine 1 embodying this invention comprises a cylinder element 10 defining a generally S-shaped bore 10*a* which constitutes a fluid pressure chamber for the apparatus. Cylinder element 10 is mounted for oscillating movement about an axis defined by a shaft 2. For this purpose, the cylinder element 10 may be secured by a plurality of straps 12 to a circular plate 14 which in turn is suitable keyed or welded to shaft 2.

Figure 1:
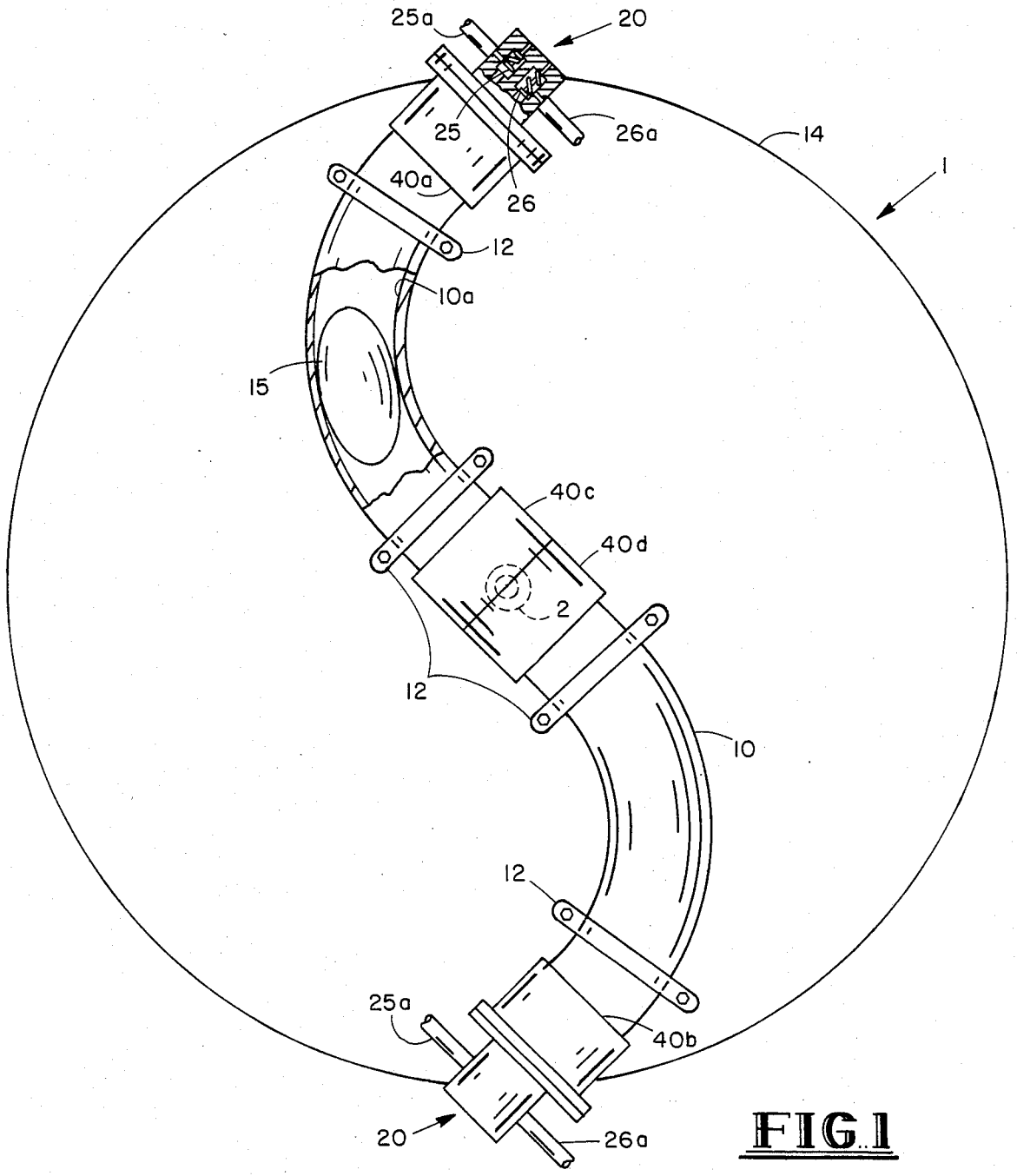
FIG. 1 is a schematic, elevational view of an apparatus embodying this invention utilizing a single cylinder element defining an elongated, S-shaped fluid pressure chamber.

On each end of the cylinder element 10, there are respectively provided identical valving heads 20 which respectively include a solenoid operated pressure inlet valve 25 which controls the supply of pressured fluid from a supply conduit 25*a*. Additionally, each valving head 20 includes a solenoid operated exhaust valve 26 which permits exhausting of the fluid pressure from the cylinder 10*a* into an exhaust conduit 26*a*.

A free piston 15 is mounted for sliding sealable movements along the S-shaped fluid pressure chamber 10*a*. Such piston may comprise an ellipsoid shaped piston, as illustrated, or it may comprise a ball. It is preferably fabricated from a ferrous material or contains a permanent magnet to facilitate the operation of the control circuit to be hereinafter described. In any event, the free piston 15 is movable along the entire length of the S-shaped fluid pressure chamber 10*a* solely under the influence of fluid pressure and centrifugal forces.

To control the operation of the pair of solenoid inlet valves 25 and the pair of solenoid exhaust valves 26, it is necessary that the position of the free piston 15 in the S-shaped fluid pressure chamber 10*a* be detected. Accordingly, a plurality of electronic detecting devices are mounted in spaced relationship along the path of movement of free piston 15. Thus, two detecting devices 40*a* and 40*b* are respectively disposed adjacent the outer ends of the S-shaped fluid pressure chamber 10*a*, while two more detecting devices 40*c* and 40*d* are mounted adjacent the medial portions of the S-shaped fluid pressure chamber 10*a*.

Figure 2:
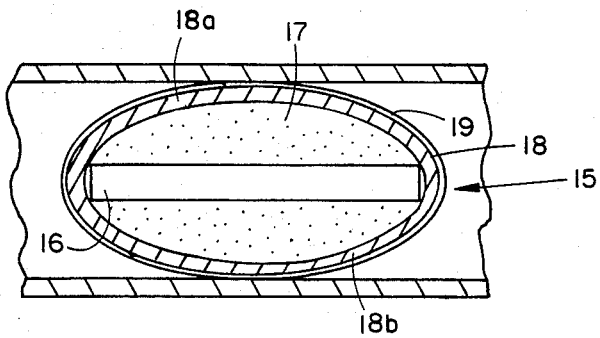
FIG. 2 is an enlarged scale sectional view of the free piston utilized in FIG. 1.

While the sensing devices 40 may incorporate either a conventional electrostatic or electromagnetic sensor, I preferably employ an electromagnetic sensor and a free piston 15 of ellipsoid configuration containing a permanent magnet 16 (FIG. 2) disposed in general alignment with the major axis of the ellipsoid piston. The remainder of the interior of the free piston 15 may be filled with any heavy non-ferrous metal 17, such as mercury on lead shot.

Piston 15 preferably comprises a thin-walled shell 18 formed by the welded assemblage of two stamped half portions 18*a* and 18*b*. The exterior ellipsoid surface of piston 15 is coated with an organic plastic material 19 having good lubricating and sealing properties, such as plastics sold under the Dupont trademarks "TEFLON" and "KALREZ".

Figure 3:
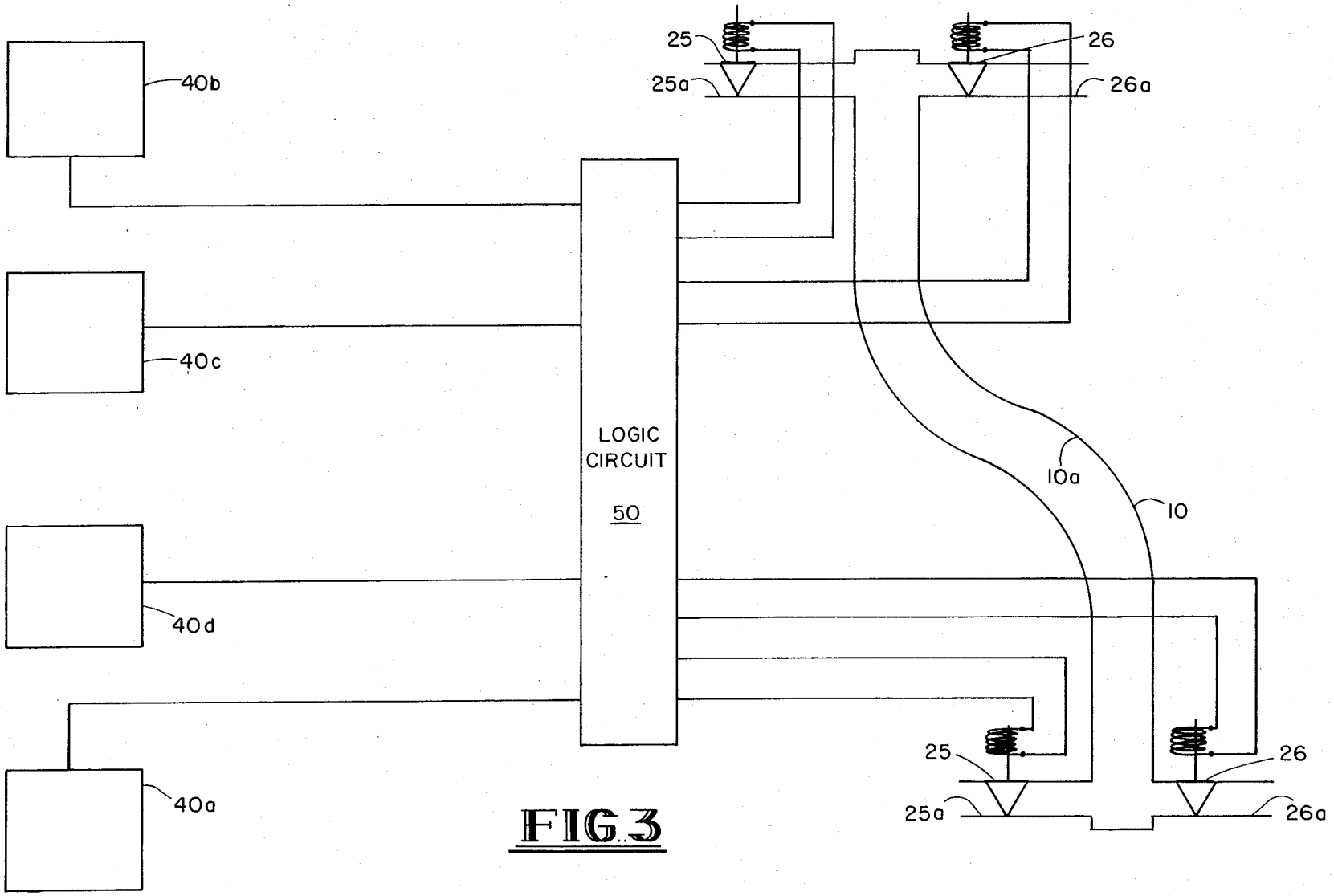
FIG. 3 is a schematic circuit diagram illustrating the control circuitry utilized in operating the apparatus of FIG. 1.

Referring now to FIG. 3, there is schematically indicated an electronic circuit for effecting the control of the solenoid valves 25 and 26 to effect the continuous reciprocation of the piston element 30 throughout the length of the S-shaped fluid pressure chamber 10*a*. The sensing devices 40*a*, 40*b*, 40*c* and 40*d* are connected through a logic circuit 50 to provide the required sequential operation of the solenoid operated inlet valves 25 and the solenoid operated exhaust valves 26 provided in each valving head 20 in accordance with the position of the free piston 15 in the fluid pressure chamber 10*a*. Thus, when the free piston 15 is adjacent the one diametrical end of the fluid pressure chamber 10*a* at which the sensing unit 40*a* is located, such sensing unit will operate through the logic circuit 50 to effect an opening of the adjacent pressured inlet valve 25 and a closing of the adjacent exhaust valve 26. Contemporaneously, the exhaust valve 26 at the opposite end of the fluid pressure chamber 10*a* will be opened. Accordingly, the free piston 15 will be driven inwardly by the charge of pressured gas and, if no other control functions were provided, the pressured gas would continue to be supplied to the piston 15 to drive it past the axis of oscillation to the opposite end of fluid pressure chamber. During all the time that the fluid pressure is acting on the free piston 15, a reaction force is being exerted by such fluid pressure against the valving head behind the piston, thus producing a clockwise torque on the cylinder element 10 and the supporting body 14, however, a counter clockwise torque is produced by the reaction of piston 15 on the curved portions of fluid pressure chamber 10*a*.

When the free piston 15 approaches the diametrically opposite end of the S-shaped fluid pressure chamber 10*a*, its presence will be picked up by detecting device 40*b* and the signal thus generated applied to the logic circuit 50 with the result that the fluid pressure inlet valve 25 adjacent the free piston will be opened and the exhaust valve 26 will be closed. This permits the applied fluid pressure to provide a cushioned stop for the movement of the piston 15 toward such opposite end and a substantial portion of the energy derived from such cushioned stop is applied in a direction to aid in rotating the cylinder 10, and hence the power shaft 2, in a clockwise direction. In other words, a portion of the pressured gas energy is converted into kinetic energy of the piston which is transmitted to the cylinder head at the end of each piston stroke to exert a clockwise torque on the cylinder 10 and shaft 2. The exhaust valve 26 at the opposite diametrical end of the S-shaped fluid pressure chamber 10*a* will be opened to exhaust the expanded and cooled gas and the piston 15 will reverse its movement through the S-shaped fluid pressure chamber 10*a*, thus functioning as a double acting free piston. Sensing unit 40*a* is again activated as the free piston approaches its original position thus repeating the cycle.

On the other hand, if it is desired to optimize the expansion of the pressured gas supplied to the fluid pressure chamber 10*a*, then the sensing devices 40*c* and 40*d* come into play. These devices respectively generate signals when the free piston 15 passes therethrough. Such sensing devices may be positioned adjacent the rotational axis as shown, or radially spaced therefrom.

The sensing devices 40*c* and 40*d* are both connected to the logic circuit 50. Sensor 40*a* functions as previously described. The logic circuit 50 responds to the energization of pickup device 40*c* by closing the nearest fluid pressure inlet valve 25 which is supplying fluid pressure to the piston, thus trapping the gas previously supplied behind the piston and permitting such gas to expand during the remainder of travel of the piston 30 to the opposite diametrical end of the S-shaped fluid pressure chamber 10*a*. Sensor 40*b* functions as previously described. The sensing device 40*d* is responsive to movement of the free piston 15 in the opposite direction to perform the same function as sensor 40*c*. Obviously, the permanent magnet 16 incorporated in the ellipsoid-shaped piston 15 produces an opposite signal in sensing devices 40*c* and 40*d* depending on the direction of movement of the free piston 15 with respect thereto, so that the reverse strokes of the free piston 15 have no effect.

The utilization of the cooled, expanded gases produced by the aforedescribed apparatus is accomplished in any of the manners illustrated in the co-pending application of Edwin Walter Dibrell, Ser. No. 418,651, filed Sept. 16, 1982 now U.S. Pat. No. 4,420,944 and assigned to the Assignee of the instant application. For example, the exhaust gas conduits 26*a* may be connected to the inlet of a heat exchanger.

Those skilled in the art will recognize that other valving mechanisms responsive to the position of the free piston 15 may be employed in place of the electromagnetic sensing devices and solenoid operated valves heretofore described. For example, the inlet valves may be mechanically operated by a stem portion projecting into the end of the fluid pressure chamber 10*a* and shifted to an open position by impact of the free piston with the internally projecting stem. Exhaust valves may comprise ports in the side walls of the cylinder 10 which are uncovered by the passage of the free piston 15 and thus, function to exhaust the pressured gas behind the piston. All such valving devices responsive to the position of the free piston in the fluid pressure chamber are encompassed within the phrase "valve means responsive to the position of the free piston."

Figure 4:
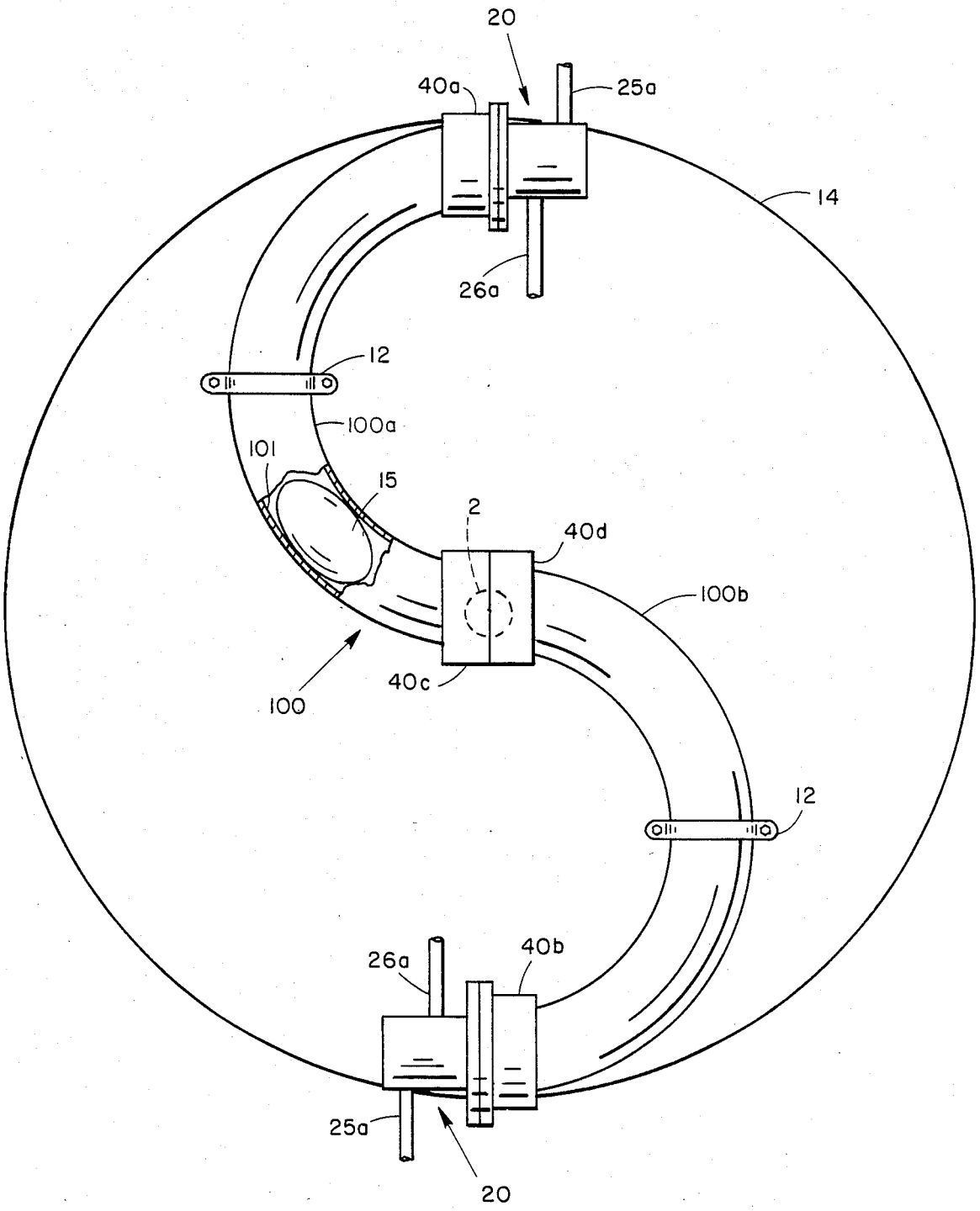
FIG. 4 is a schematic, elevational view of a modified form of an S-shaped fluid pressure chamber.

Referring to FIG. 4, there is shown a modification of this invention wherein the S-shaped cylinder element 100 essentially comprises two semi-circular sections 100*a* and 100*b* which have their abutting ends located adjacent the rotation axis of shaft 2 and have valving heads 20, as previously described, respectively secured to their diametrically opposed ends. The end portions of cylinder 100 are thus substantially aligned with a diametrical plane passing thru the axis of shaft 2. The cylinder element 100 thus defines an S-shaped fluid pressure chamber 101 wherein the end walls of the fluid pressure chamber are both disposed in substantially radial planes with respect to the axis of rotation. This maximizes the torque arm available for the clockwise reaction force exerted by the expanding gas on the cylinder heads. On the other hand, the difference in area of the curved side walls of fluid pressure chamber 100*a* produces a substantial counter clockwise torque on cylinder 100. Other elements of the apparatus are identical to those previously described in connection with the modification of FIG. 1, including the employment of an ellipsoid-shaped free piston 15 carrying a permanent magnet and the utilization of four sensing devices 40*a*, 40*b*, 40*c* and 40*d* to respectively control the pressure fluid outlet valves (not shown) and the solenoid control exhaust valves (not shown).

When the aforedescribed apparatus of FIG. 4 is simulated on the computer and the effective torque acting on the free piston 15 is computed at a plurality of positions on both sides of the axis of shaft 2, throughout a complete cycle of movement of free piston 15, the computer output data indicates that during the inward movement of the free piston from the outer extremity of the S-shaped fluid pressure chamber 101 towards the rotational axis center, a net torque in a clockwise direction is produced on the cylinder 100, hence on the supporting plate 14, causing this assemblage and the connected shaft 2 to rotate in a clockwise direction about the shaft axis. However, as the free piston approaches the axis and proceeds outwardly to the other extremity of the S-shaped fluid pressure chamber 101, the computer data surprisingly indicates that a torque pulse is developed of substantial magnitude in the opposite direction so that at the end of a complete cycle of operation of the free piston from one end of the S-shaped cylinder 100 to the other and then return, four sequential pulses of torque will be produced on the output shaft 2, two of which pulses will be in a clockwise direction and two of which will be in a counter clockwise direction.

The other outstanding characteristic of the described apparatus is that the torque produced is of very large magnitude, even with a modest fluid pressure of the inlet gas, considering the fact that the engine is at rest or moving very slowly. Thus, the described apparatus finds particular utility as a source of reciprocating power for loads that require very substantial torque to be applied over a relatively short distance of movement.

Figure 5:
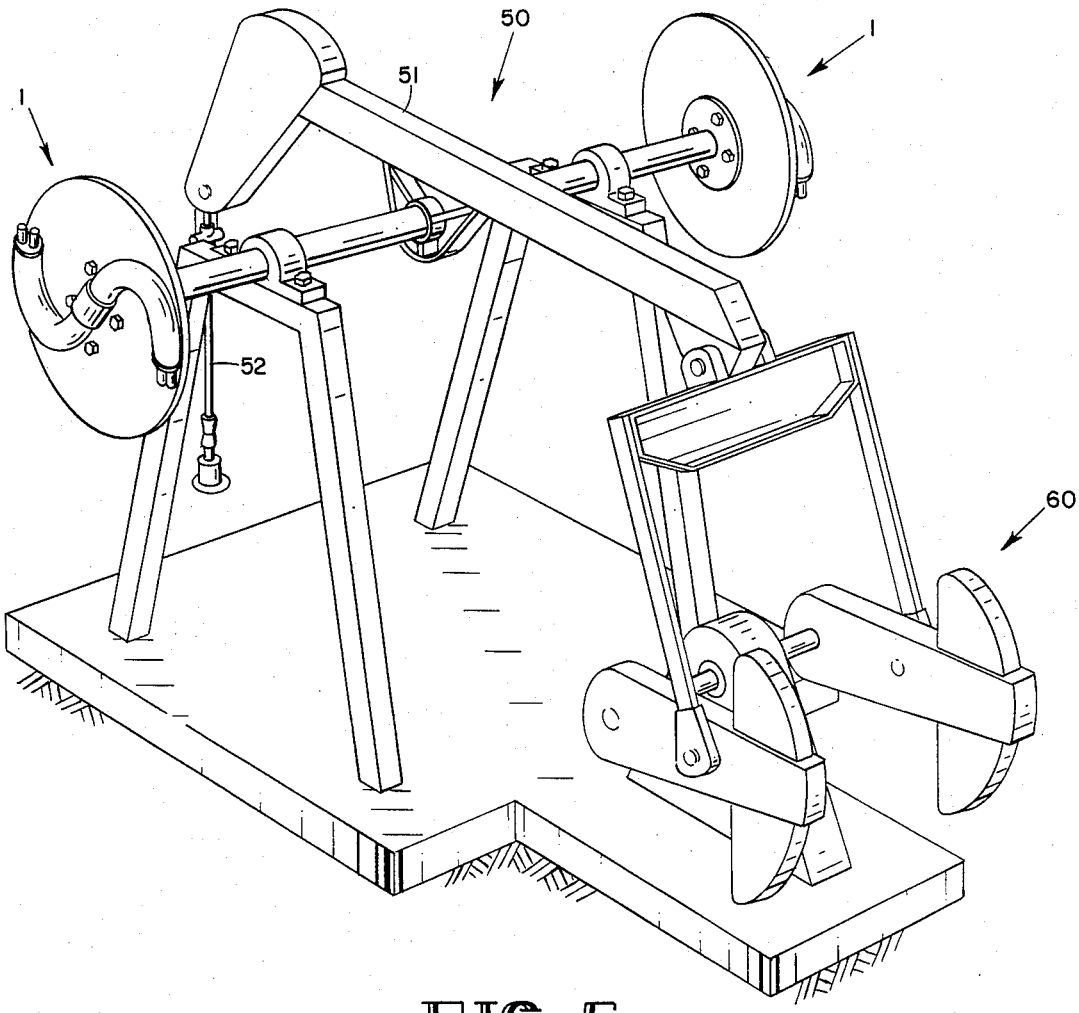
FIG. 5 is a schematic, perspective view illustrating the connection of the reciprocating engine embodying this invention to the walking beam of a subterranean well pump.

Similar outputs may be derived from the other cylinder configurations described in the aforementioned pending applications. Thus, as illustrated in FIG. 5, two of the expander apparatuses 1 can be mounted on opposite ends of a pivot shaft 53 of a pivotally mounted walking beam 51 of a subterranean well pumping unit 50 having a pumping rod string 52 secured to one end of the walking beam 51 and extending to a subterranean pump (not shown) disposed in the well. Of course, a conventional rotating counter weight apparatus 60 may be connected to the other end of the walking beam 51 so as to optimize the utilization of the reversing torque produced by the apparatus 1.

Figure 6:
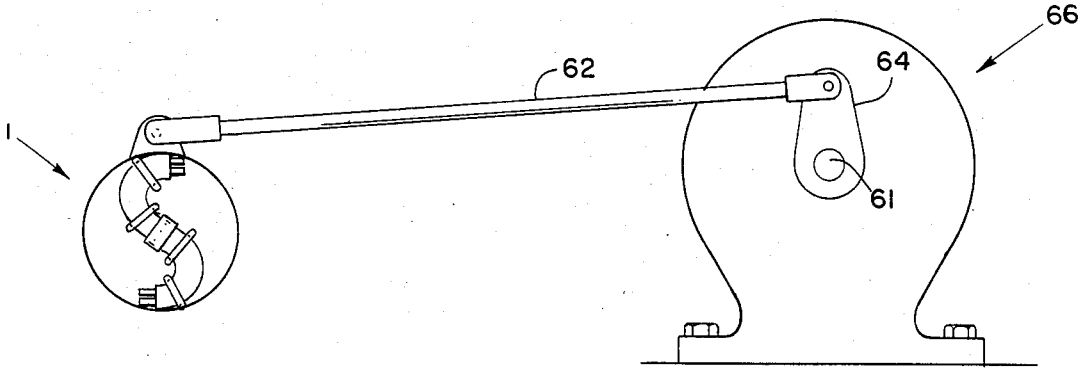
FIG. 6 is a schematic, elevational view of a reciprocating engine embodying this invention driving a rotating electric generator by a crank linkage.

As shown in FIG. 6, the oscillating torque output of expander 1 may be utilized to drive a conventional rotary generator 66 by a link 62 connected to a crank 64 secured to generator shaft 61.

Figure 7:
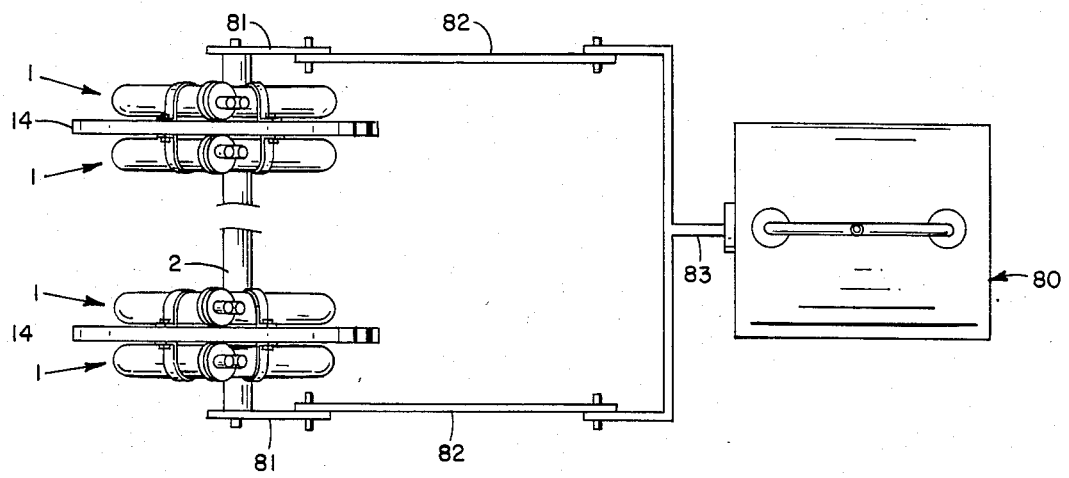
FIG. 7 is a schematic, plan view illustrating the connection of a reciprocating engine embodying this invention to a double acting reciprocating irrigation pump.
Figure 8:
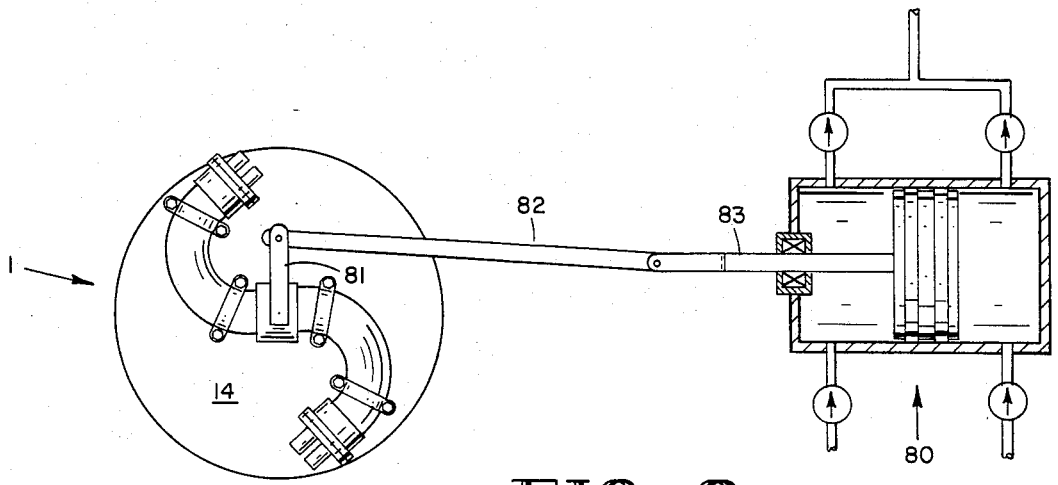
FIG. 8 is an elevational view partly in section, of FIG. 7.

As illustrated in FIGS. 7 and 8, a plurality of expander apparatuses 1 may be mounted on a common shaft 2 and may be connected by cranks 81 and connecting rods 80 to the power shaft 83 of a conventional double acting fluid pump 80, or other form of reciprocating load. Because of the high torque characteristics of the apparatus 1, a substantial load may be moved during each of the strokes of the oscillating engines 1. More importantly, a large number of free pistons may be used with only one, or at most two, cranks and connecting rods.

Figure 9:
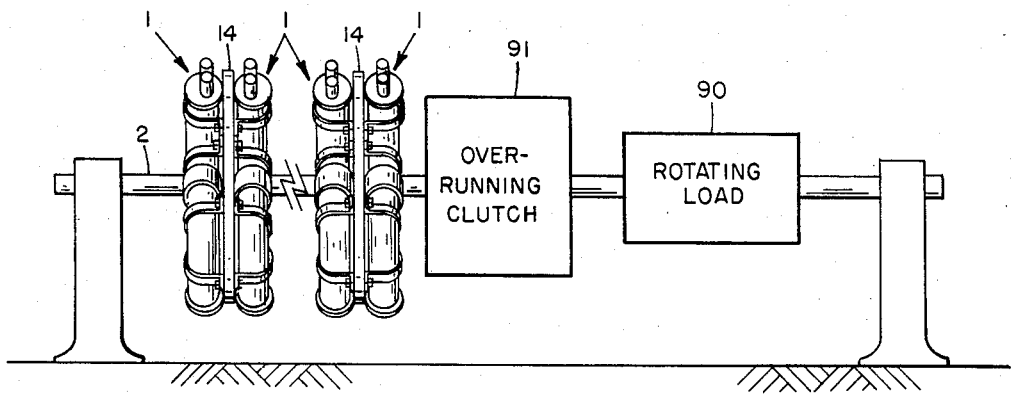
FIG. 9 is a schematic elevational view of the connection of a reciprocating engine embodying this invention to a rotating load thru an over-running clutch.

Referring now to FIG. 9, one or a plurality of oscial-lating engines 1 may be co-axially mounted on a common output shaft 2 which drives a rotating load 90 through a conventional over-running clutch 91. Clutch 91, for example, may comprise a over-running clutch that is sold under the trademark "FORMSPRAG" by Dana Corporation of Toledo, Ohio.

Figure 10:
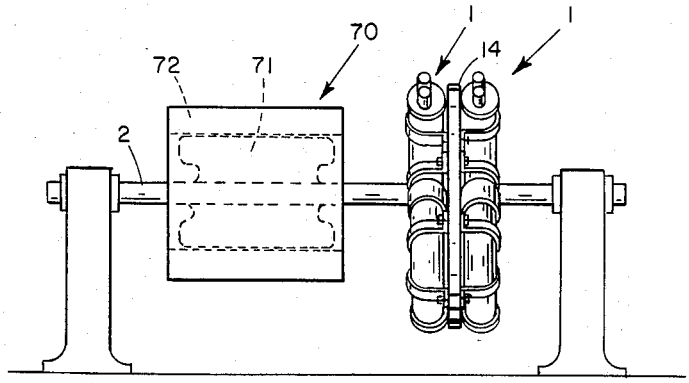
FIG. 10 is a schematic, side elevational view of an expander device embodying this invention deriving an oscillating electrical generator.

Alternatively, as schematically illustrated in FIG. 10, the apparatus 1 may be employed to drive a reciprocating type electrical generator which is known in the prior art. In this instance, the shaft 2 of the apparatus 1 would be connected directly to the oscillating rotor 71 of the reciprocating electrical generator 70 having a stator 72. Rotor 71 comprises a plurality of radially disposed permanent magnets, or poles magnetized by a direct current flowing thru coils encircling the poles.

To illustrate the amount of torque developed by a oscillating engine 1 embodying this invention, from a relatively low pressure source of gas, such as currently derived from solar energy conversion systems, the following data was entered into the computer program for an apparatus constructed in accordance with the modification of FIG. 4:

| | |
|---|---|
| Diameter length of S-shaped cylinder | 20 inches |
| Piston Area | 20 sq. inches |
| Mass of piston | 40 lbs. |
| Pressure of applied gas | 50 p.s.i. |
| Assumed load torque | 20 ft. lbs. |

The peak output torque developed on the S-shaped cylinder was found to be on the order of 250 foot pounds in one direction of oscillation of the S-shaped cylinder.

A second computer simulation was run wherein the only change made was the doubling of the load torque to 40 foot pounds. The peak output torque developed by the expander device increases to about 450 foot pounds in the one direction of oscillation of the S-shaped cylinder. When the load torque was increased to 80 ft. lbs, a peak output torque of over 600 ft. lbs. is produced in one direction of oscillation.

This characteristic of developing higher peak torques to counteract higher assumed load torques indicated that a computer simulation wherein this characteristic was optimized would be desirable. Accordingly, the expander configuration FIG. 11 was conceived wherein a pair of identical linear cylinders 200 were mounted on the oscillating body 14 of the expander in parallel relationship to each other, but located on opposite sides of the axis of oscillation of the output shaft 2. The cylinders 200 are held in position on the body plate 14 by a plurality of bolted straps 212. Because the cylinder configuration was linear, conventional cylindrical pistons 215 were employed having at least a pair of piston rings 216 mounted thereon. As in the other modification heretofore mentioned, the ends of cylinders 200 were equipped with valving heads 220 including an inlet valve (not shown) and an outlet valve (not shown) in each valving head.

Figure 11:
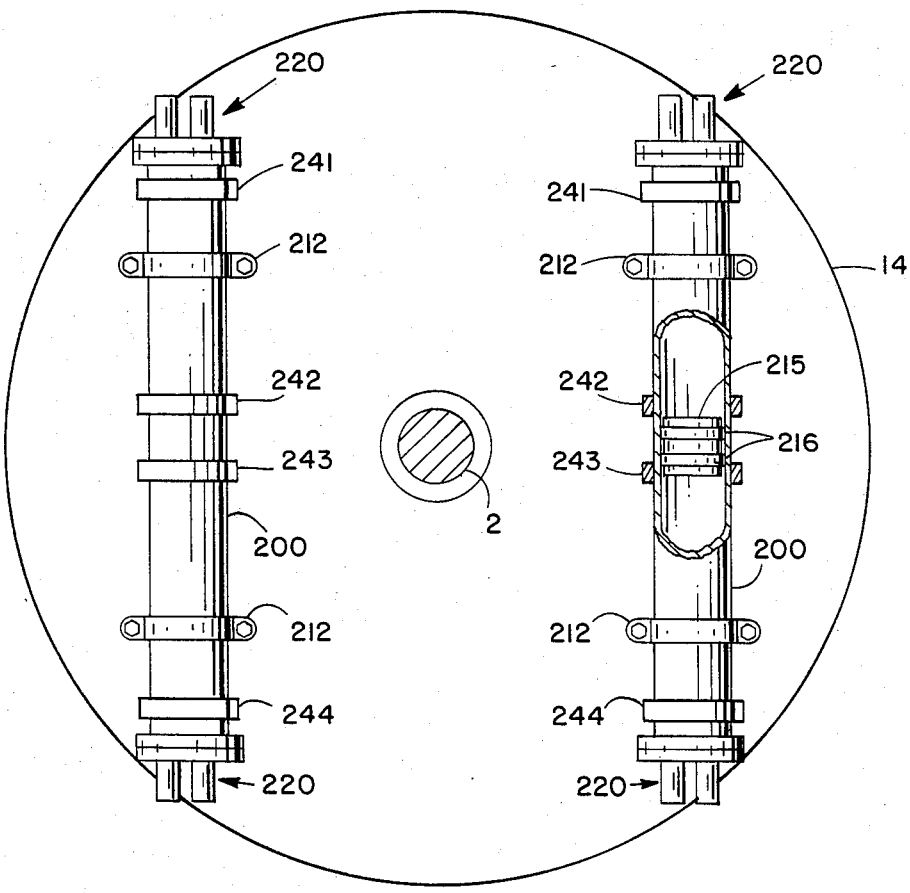
FIG. 11 is a schematic, side elevational view of an expander device comprising a pair of parallel cylindrical fluid pressure chambers.

The operation of the expander shown in FIG. 11 is accomplished in the same manner as previously described with piston detecting elements 241, 242, 243 and 244 being mounted respectively adjacent one end of the cylinders, adjacent the center portions, and the last one mounted adjacent the other end of the cylinders. These detecting devices detect the position of the respective free piston 215 and control the opening and closing of the inlet and exhaust valves in accordance with the control circuit illustrated in FIG. 3 and previously described in detail. After each power stroke, the expanded and cooled gas is discharged through the outlet valves.

With this configuration of an expander device, a set of torque output curves was then generated through computer simulation of a single cylinder device for three different assumed load torques. Again, the computer simulation expander device shows that it will produce a pulsating torque and that the magnitude of such torque in one direction will increase sharply in response to increases in the assumed load torque. The key variable assumptions utilized to develop such data are:

| | |
|---|---|
| Piston Area | 20 sq. inches |
| Piston Weight | 20 lbs. |
| Gas Pressure | 100 p.s.i. |
| Cylinder Length | 24 inches |
| Cylinder offset from axis | 12 inches |

A load torque of 80 ft. lbs. developed a peak output torque of 2,200 ft. lbs. in one direction of oscillation, 100 ft. lbs. load torque developed 4,800 ft. lbs, and 120 ft. lbs. load torque developed a peak output torque of 5,400 ft. lbs.

It will therefore be apparent to those skilled in the art that a new form of oscillating engine has been provided which will efficiently extract both mechanical energy and heat from an applied pressured gas. It should be mentioned that if the exhaust gas is cooled sufficiently to be of value as heat exchange medium, it can, of course, be conducted to a suitable heat exchange device or, if the pressured gas is air, the cooled expanded gas exhausted from the expander apparatus may be conducted directly into a room for cooling purposes.

It should be recognized that in place of introducing a charge of pressurized gas into the fluid pressure chamber in any of the modifications of this invention, an alternative procedure would be to introduce a charge of combustible gas and air which is then ignited by a suitable spark plug disposed in each end of the fluid pressure chamber. The resulting explosion will produce a charge of highly pressured gas to effect the driving of the free piston towards the other end of the cylinder.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. Apparatus for producing oscillating movement of a body mounted for oscillating movement about an axis; cylinder means defining an elongated fluid pressure chamber having a longitudinal axis; means for rigidly mounting said cylinder means on said body with one end of said fluid pressure chamber being radially remote from said oscillation axis; said longitudinal axis being substantially non-radial throughout its length; said fluid pressure chamber having a uniform cross-section throughout its length; a free piston mounted in said fluid pressure chamber for sliding sealable movement throughout the length thereof; first and second valve means responsive to the position of said free piston for respectively supplying pressured gas to the ends of said fluid pressure chamber; third and fourth valve means responsive to the position of said free piston for respectively exhausting expanded gas from said fluid pressure chamber; thereby causing said piston to continuously reciprocate from one end to the other of said fluid pressure chamber and produce continuous oscillating movements of said body about said axis.

2. The apparatus of claim 1 wherein said free piston comprises a container filled with one of a class of heavy metals including lead and mercury.

3. The apparatus of claim 1 wherein said free piston is exteriorly coated with an organic plastic material having lubricating and sealing properties.

4. The apparatus of claim 1 wherein said valve means responsive to the position of said piston detecting means are magnetically sensitive and said piston includes a permanent magnet.

5. The apparatus of claim 1 wherein said fluid pressure chamber has a curved longitudinal axis.

6. The apparatus of claim 5 wherein said free piston comprises a ball.

7. The apparatus of claim 1 wherein said fluid pressure chamber has an S-shaped longitudinal axis.

8. The apparatus of claim 7 wherein said free piston comprises an ellipsoid having a minor axis diameter substantially equal to but less then the diameter of said fluid pressure chamber.

9. The apparatus of claim 7 wherein said S-shaped fluid pressure chamber has diametrically opposed end walls, each end wall being positioned in a substantially diametrical plane relative to said axis of oscillation.

10. The apparatus of claim 7 wherein said S-shaped longitudinal axis of said fluid pressure chamber intersects said axis of oscillation.

11. The apparatus of claim 1 wherein said valve means responsive to the position of said free piston comprises a plurality of piston detecting means spaced along the length of said cylinder means; two of said piston detecting means being respectively disposed adjacent the outermost ends of said fluid pressure chamber and respectively operative to open the adjacent one of said first and second valve means and the diametrically spaced one of said third and fourth valve means as said piston approaches one of the outermost ends of said S-shaped fluid pressure chamber.

12. The apparatus of claim 11 wherein a third and fourth one of said piston detecting means being respectively disposed along the medial portion of said fluid pressure chamber, said third piston detecting device being responsive to piston movement in one direction and said fourth piston detecting device being responsive to piston movement in the opposite direction to close the open one of said first and second valve means to permit expansion of the pressured gas driving said piston.

13. The apparatus of claim 1 wherein the ends of said fluid pressure chamber are disposed on opposite sides of said oscillation axis.

14. The method of operating an expander to supply a continuously reversing torque load, said expander having a body mounted for oscillation about an axis, a fluid pressure chamber on the body having a longitudinal axis and a uniform cross-section, the longitudinal axis of the fluid pressure chamber being substantially non-radially disposed relative to the oscillation axis and a free piston slidably and sealably mounted for reciprocating movement in the fluid pressure chamber, comprising the steps of:

1. introducing a pressured fluid into the one end of the fluid pressure chamber to expand and drive the free piston toward the other end of the fluid pressure chamber, thereby exerting a torque pulse in one direction on the body;
2. exhausting the expanded fluid from the fluid pressure chamber;
3. stopping the motion of the free piston adjacent the opposite end of the fluid pressure chamber by fluid pressure;
4. introducing a pressured fluid into said opposite end of the fluid pressure chamber to expand and drive the free piston in a reverse path, thereby exerting a torque pulse on the body in the opposite direction; and
5. repeating steps 2 and 3 to stop the return movement of the free piston to said one end of the fluid pressure chamber; thereby producing an oscillating torque on said body about said axis having a peak value substantially in excess of the applied load torque.

15. The method of claim 14 further comprising the step of increasing the applied torque load, thereby further increasing the peak output torques produced on the expander body.

16. The method of deriving mechanical energy from a pressured gas, comprising the steps of:

(1) mounting a cylinder defining an elongated fluid pressure chamber for oscillation about an axis transverse to and spaced from the elongated axis of the elongated fluid pressure chamber;
(2) inserting a free piston element in the elongated fluid pressure chamber for slidable sealing movement therein;
(3) applying a valving head to each end of the cylinder, each said valving head having an inlet valve;
(4) applying at least one exhaust valve to the cylinder;
(5) opening the inlet valve at one cylinder end to admit pressured fluid and closing the exhaust valve to expand the fluid and move the free piston to the other end;
(6) opening the exhaust valve to exhaust the expanded fluid; and,
(7) opening the inlet valve at the other cylinder end and closing the exhaust valve as the free piston approaches said other end, thereby producing a reciprocating movement of the free piston in the elongated fluid pressure chamber and reaction forces on the cylinder producing the oscillation thereof about said axis.

17. The method of expanding and cooling a pressured gas while deriving mechanical energy therefrom, comprising the steps of:

(1) mounting a cylinder defining an S-shaped fluid pressure chamber for oscillation about an axis transverse to the elongated axis of the chamber at its center;
(2) inserting a free piston element in the S-shaped fluid pressure chamber for slidable sealing movement therein;
(3) applying a valving head to each end of the cylinder, each said valving head having a power operated inlet valve and exhaust valve;
(4) opening the inlet valve to admit pressured fluid and closing the exhaust valve at one cylinder end and closing the inlet valve and opening the exhaust valve at the other cylinder end as the free piston moves toward said one end, thereby producing a reciprocating movement of the free piston and reaction forces on the cylinder producing the oscillation thereof about said axis;

(5) closing the opened inlet valve in one cylinder end after the free piston has moved a pre-selected distance toward the other cylinder end, thereby trapping the pressured fluid charge for expansion until the free piston approaches the other cylinder end;

(6) exhausting the expanded gas; and, (7) closing the exhaust valve and opening the inlet valve at said other cylinder end to reverse the movement of the free piston in the S-shaped fluid pressure chamber, thereby producing reversing torque pulses on said cylinder.

18. The method of extracting mechanical energy from a pressured gas, comprising:

(1) mounting a cylinder defining an elongated fluid pressure chamber for oscillation about an axis transverse to and spaced from the elongated axis of the chamber;

(2) permitting a free piston to slidably and sealably move in said elongated fluid pressure chamber;

(3) introducing pressured gas in said elongated fluid pressure chamber to impart kinetic energy to said piston to move toward one end of said elongated fluid pressure chamber while exerting a fluid pressure force on the cylinder to produce oscillation of said cylinder about said axis; and (4) transmitting said kinetic energy of said piston to a charge of gas in said one end of fluid pressure chamber to further augment the oscillation movements of said cylinder.

19. Apparatus for producing oscillating movement of a body mounted for oscillating movement about an axis by expansion and cooling of a pressured gas comprising:

cylinder means defining an elongated fluid pressure chamber having a longitudinal axis;

means for rigidly mounting said cylinder means on said body with one end of said fluid pressure chamber being radially remote from said oscillation axis;

said longitudinal axis being substantially non-radial throughout its length;

said fluid pressure chamber having a uniform cross-section throughout its length;

a free piston mounted in said fluid pressure chamber for sliding sealable movement throughout the length thereof;

first and second value means responsive to the position of said free piston for respectively supplying pressured gas to the ends of said fluid pressure chamber;

third and fourth valve means responsive to the position of said free piston for respectively exhausting expanded and cooled gas from said fluid pressure chamber;

thereby causing said piston to continuously reciprocate from one end to the other of said fluid pressure chamber and produce continuous oscillating movements of said body about said axis.

20. The method of operating an expander by expansion and cooling of a pressured gas, said expander having a body mounted for oscillation about an axis, a fluid pressure chamber on the body having a longitudinal axis and a uniform cross-section, the longitudinal axis of the fluid pressure chamber being substantially non-radially disposed relative to the oscillation axis, and a free piston slidably and sealably mounted for reciprocating movement in the fluid pressure chamber, comprising the steps of:

1) introducing a pressured fluid into the one end of the fluid pressure chamber to expand and drive the free piston toward the other end of the fluid pressure chamber, thereby exerting a torque pulse in one direction on the body;

2) exhausting the expanded and cooled fluid from the fluid pressure chamber;

3) stopping the motion of the free piston adjacent the opposite end of the fluid pressure chamber by fluid pressure;

4) introducing a pressured fluid into said opposite end of the fluid pressure chamber to expand and drive the free piston in a reverse path, thereby exerting a torque pulse on the body in the opposite direction; and 5) repeating steps 2 and 3 to stop the return movement of the free piston to said one end of the fluid pressure chamber; thereby producing an oscillating torque on said body about said axis having a peak value substantially in excess of the applied load torque.

21. The method of extracting heat and mechanical energy from a pressured gas, comprising the steps of:

1) mounting a cylinder defining an elongated fluid pressure chamber for oscillation about an axis transverse to and spaced from the elongated axis of the elongated fluid pressure chamber;

2) inserting a free piston element in the elongated fluid pressure chamber for slidable sealing movement therein;

3) applying a valving head to each end of the cylinder, each said valving head having an inlet valve;

4) applying at least one exhaust valve to the cylinder;

5) opening the inlet valve at one cylinder end to admit pressured fluid and closing the exhaust valve to expand the fluid and move the free piston to the other end;

6) opening the exhaust valve to exhaust the expanded and cooled fluid; and 7) opening the inlet valve at the other cylinder end and closing the exhaust valve as the free piston approaches said other end, thereby producing a reciprocating movement of the free piston in the elongated fluid pressure chamber and reaction forces on the cylinder producing the oscillation thereof about said axis.

* * * * *